US006042047A

United States Patent [19]

Thievessen

[11] Patent Number: 6,042,047

[45] Date of Patent: Mar. 28, 2000

[54] UNWINDER DEVICE FOR REELS

[75] Inventor: Karl Thievessen, Grevenbroich, Germany

[73] Assignee: Jagenberg Papiertechnik GmbH, Neuss, Germany

[21] Appl. No.: 09/180,458

[22] PCT Filed: Mar. 6, 1998

[86] PCT No.: PCT/EP98/01320

§ 371 Date: Nov. 5, 1998

§ 102(e) Date: Nov. 5, 1998

[87] PCT Pub. No.: WO98/45197

PCT Pub. Date: Oct. 15, 1998

[30] Foreign Application Priority Data

Apr. 3, 1997 [DE] Germany ..... 197 13 790

[51] Int. Cl.[7] ..... B65H 16/06; B65H 19/12

[52] U.S. Cl. ..... 242/559.4; 242/399.1; 242/596.1

[58] Field of Search ..... 242/559.4, 129.51, 242/129.53, 596.1, 399.1, 470

[56] References Cited

U.S. PATENT DOCUMENTS

| | | | |
|---|---|---|---|
| 1,874,904 | 8/1932 | Crafts . | |
| 2,652,207 | 9/1953 | Goedken | 242/596.1 |
| 3,216,672 | 11/1965 | Littell | 242/596.1 |
| 4,681,274 | 7/1987 | Thievessen et al. | 242/559.4 |
| 5,033,687 | 7/1991 | Bates | 242/129.51 |
| 5,060,878 | 10/1991 | Hutzenlaub et al. | 242/129.51 |
| 5,607,120 | 3/1997 | Folsom | 242/559.4 |
| 5,651,511 | 7/1997 | Crowley et al. | 242/559.4 |
| 5,697,575 | 12/1997 | Moore et al. | 242/559.4 |

FOREIGN PATENT DOCUMENTS

| | | |
|---|---|---|
| 0 497 105 A1 | 8/1992 | European Pat. Off. . |
| 85 11 986 U | 10/1986 | Germany . |

*Primary Examiner*—John M. Jillions
*Attorney, Agent, or Firm*—Herbert Dubno

[57] ABSTRACT

For unwinding of wound rolls, devices are known which have a frame composed of longitudinal girders and transverse girders and an unwinding beam mounted in the frame and which extends over the working width. On the unwinding beam two support beams are mounted so as to be transversely shiftable and carry at their free ends respective guide heads for insertion in the sleeve of a wound roll. The unwinding beam is suspended in the frame on tension means, especially cables which are raisable and lowerable by mans of a lifting drive. The pendulously movable suspension enables an automatic positioning of the guide heads in their insertion into the sleeve of a wound roll.

8 Claims, 3 Drawing Sheets

UNWINDER DEVICE FOR REELS

CROSS REFERENCE TO RELATED APPLICATIONS

This application is a national stage of PCT/EP98/01320 filed Mar. 6, 1998 and based, in turn, on German national application 197 13 790.3 of Apr. 3, 1997.

FIELD OF THE INVENTION

The present invention relates to an unwinding device for wound rolls, especially for paper rolls or cardboard rolls.

BACKGROUND OF THE INVENTION

In the paper processing or cardboard processing industry, such unwinding devices are used to withdraw one or more paper webs or cardboard webs from one or more wound rolls and to feed them to a subsequent processing machine, e.g. a transverse cutting machine. The wound rolls are held during the unwinding without a shaft between two guide heads clamping the wound roll between them and journaled on respective carrying arms. For loading the device with a new wound roll, for removing the roll residue and for adjustment to different rolls widths, the carrying arms with the guide heads are mounted so as to be movable toward and away from one another. In addition, the guide heads can be raised to lift a new wound roll from a receiving position on the floor to an unwinding position.

From German Utility Model G 85 11 986 an unwinding device of the aforedescribed type is known which has a transverse traverse on which the support beams are mounted so as to be transversely shiftable. The support beams are variable as to their lengths and carry the guide heads at their ends, the guide heads being insertable in the sleeve of a wound roll. The support beams are, in addition, swingable upwardly in order to provide a free space through which the device can be charged with a new wound roll from the side.

With the known unwinding devices it is necessary to position a new wound roll in the receiving position with relatively high accuracy so that the guide heads can be inserted into a sleeve in a problem-free manner. An excessive deviation from the setpoint position of the wound roll can lead to jamming of the guide heads during insertion. As a consequence, extensive aligning devices, (e.g. special lifting devices) are required to position the wound rolls with the requisite precision in their receiving positions in case the roll reception is to be effected automatically.

OBJECT OF THE INVENTION

The invention presents the object of so improving a device of the type described that the wound rolls can be picked up without exact positioning by means of expensive alignment devices.

SUMMARY OF THE INVENTION

This object is achieved in an unwinding for wound rolls which has a frame with longitudinal and transverse girders and an unwinding beam suspended in the frame so that it can swing in a pendulum fashion freely to allow guide heads at the ends of two support arms carried by the unwinding beam to fit into corresponding ends of a wound roll. According to the invention, the support arms with the guide heads are suspended movably to freely swing in the web travel direction (i.e. in the longitudinal direction of the machine) in a pendulum-like manner. Upon movement into the sleeve, the guide heads position themselves automatically as long as the tips of the guide heads engage in the sleeve. With large deviations from the sleeve position, the guide heads can be aligned to the sleeve flush by a service person.

A further advantage is that it is possible to laterally swing the support arms upwardly without excessive structural expense to afford a place for charging with an unwound roll. The lifting drive can serve simultaneously as the swing drive to enable the desired swinging movement during the lifting movement of the support arms.

According to a feature of the invention, the unwinding beam has, on each machine side a cable, belt or chain connected to the common lifting drive. The support arms can be movable toward and away from each other on the unwinding beam by an adjustment drive affixed thereto. The support arms can be additionally mounted so as to be transversely shiftable limitedly equidistantly by means of a positioning drive.

According to another feature of the invention at opposite ends of the unwinding beam rollers, on which loops of the tension means can depend, the unwinding beam and the parts attached thereto being swingable about an axis of the rollers, the resulting assembly having a center of gravity which lies below this axis. Guide elements on the unwinding beam can release a swinging movement upon raising of the unwinding beam and the latter can have an abutment on an upper side thereof which is movable against the girder transverse to the unwinding beam.

BRIEF DESCRIPTION OF THE DRAWING

The drawing serves for illustration of the invention with respect to an embodiment which has been illustrated in simplified form. In the drawing.

MANNER OF PRACTICING THE INVENTION

Figure 1:
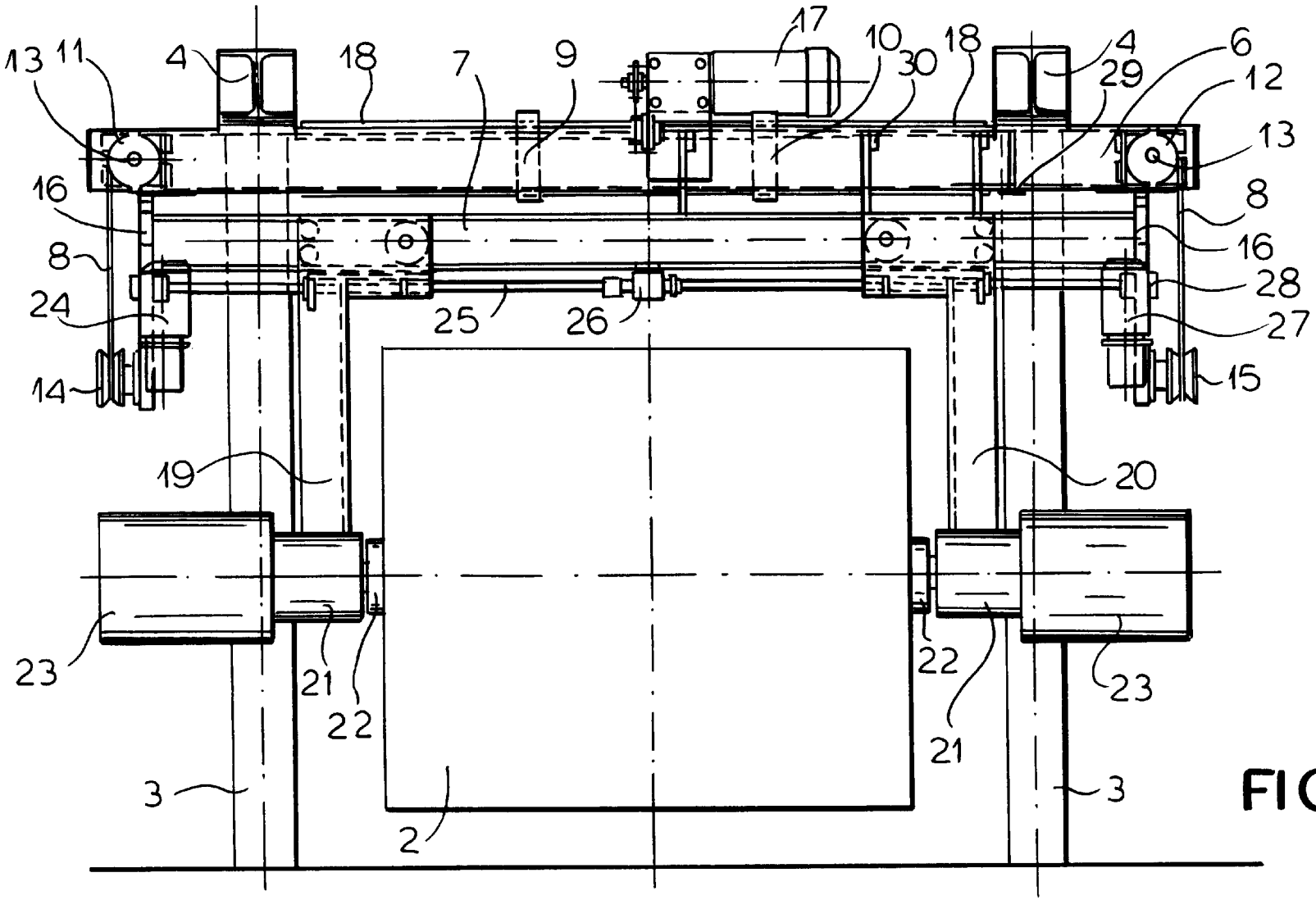
FIG. 1 shows a front elevational view in the web travel direction.

In the embodiment illustrated in the Figures and described subsequently, several (for example four) unwinding devices are provided in a common machine frame and are located one behind the other, two such devices have been illustrated in FIGS. 2 and 3. Thus, several paper webs or cardboard webs 1 can be simultaneously withdrawn from wound rolls 2 and fed one above another to a subsequent processing machine, for example, a transverse cutting machine.

The machine frame is comprised of lateral stands 3 upon which, on either machine side, a longitudinal beam 4 rests. The stands 3 are disposed laterally outwardly of the working width, i.e. the maximum width of a wound roll 2, and are arranged in the longitudinal direction preferably with a distance from one another which is sufficiently great as to enable a wound roll 2 to be supplied in an axial direction thereof from the side. Alternatively, the charging with a new wound roll can be effected also in the web travel direction from the rear toward the front. The new wound roll 2 is then supplied perpendicular to its axial direction in FIG. 2 from left or right into the machine frame.

For each unwinding device, on the underside of the longitudinal girders 4, there are fastened two transverse girders 5, 6 which are arranged parallel to one another with a spacing between them and which extend over the working width. On the two transverse girders 5, 6, unwinding beams 7 are suspended to be raisable and lowerable via traction elements, preferably cables 8 as shown in the illustrated embodiment, and extend beyond the two longitudinal girders 4 outwardly over the working width. Alternatively, suspension by belts or chains is possible. On each machine side, a cable 8 is arranged in a loop so that the two ends engage in adjustment slides 9 and 10 shiftable respectively on the transverse girders 5 and 6. The two stretches of each cable 8 are guided from the respective slides 9, 10 initially outwardly via deflecting rollers 11, 12 which are journaled so as to be freely rotatable at the ends of the transverse beams 5 and 6 about axes 13 extending in the longitudinal direction. From the loops of each cable around the deflecting rollers 11, 12, the cable stretches extend downwardly and suspend the unwinding beam 7 via the cable pulleys 14, 15 which are freely rotatable respectively in head plates 16 at ends of the unwinding beam 7.

The lifting drive for the unwinding beam 7 is provided by a spindle motor 17 which is fixed on the transverse beam 6 and drives a spindle 18 extending over the working width and which displaces the adjustment slides 9 and 10 by internal threads therein engaged with the spindle 18. The spindle 18 on one machine side has a left-hand thread and at the other machine side a righthand thread so that upon rotation by the spindle motor 17, it synchronously moves the two adjustment slides 9, 10 toward or away from one another. These movements serve to synchronously shorten or lengthen the two loops of the cables 8 on the two machine sides synchronously and thus raise and lower the unwinding beam 7.

Alternatively, a piston or cylinder unit can be provided as the lifting drives for the unwinding beam 7 and can pull on the cable 8 or a windless can be provided for pulling the cable 8. Alternatively, the cable 8 can be provided with a kind of pulley block to reduce the requisite torque of the lifting drive 17.

The unwinding beam 7 is formed as a double-T girder and carries at each side of the machine respective downwardly extending unwinding arms 19, 20. At the free ends of the respective unwinding arms 19, 20, a journal housing 21 is fastened which receives a guide head 22 which can be inserted into the sleeve of a wound roll 2 and outwardly carries a brake 23 connected with the guide head. The support arms 19, 20 are mounted on the unwinding beam 7 via rollers to be transversely shiftable, thereby enabling the guide heads 22 to be fed into or withdrawn from the sleeve of a wound roll 2. The transverse adjustment of the support arms 19, 20 is effected by means of a spindle drive whose spindle motor 24 is affixed on one side of the unwinding beam 7 at the respective head plate 16. The spindle 25 runs parallel to the underside of the unwinding beam 7 and rotates in spindle nuts which are fitted into the mounts of the unwinding arms 19 and 20 on the unwinding beam 7. Like the spindle 18, the spindle 25 has a left-hand thread on one machine side and a right-hand thread on the other machine side so that upon rotation by the spindle motor 24 the two support arms 19 and 20 are synchronously moved toward and away from one another.

In addition, the spindle 25 is journaled so as to be limitedly axially shiftable in a bearing 26 on the unwinding beam 7 at the middle of the machine so that a wound roll 2 can be positioned relative to the subsequent processing machine in the axial direction.

In the axial positioning, the two support arms 19, 20 are equidistantly shifted transversely by means of an additional motor 27 which is affixed on the head plate 16 on the opposite side from the spindle motor 24. For the axial positioning, the spindle nut 28 on this side is rotatably journaled in the head plate 16 and can be rotated by the motor 27. A rotation of the spindle nut 28 gives rise to an axial shifting of the entire spindle 25 with the support arms 19, 20. So that the spindle 25 is not screwed out of the spindle nut 28, during an adjustment of the support arms 19, 20 toward and away from one another by means of the spindle motor 24, it is required that during this movement the spindle nut 28 be rotated synchronously by the motor 27.

Figure 2:
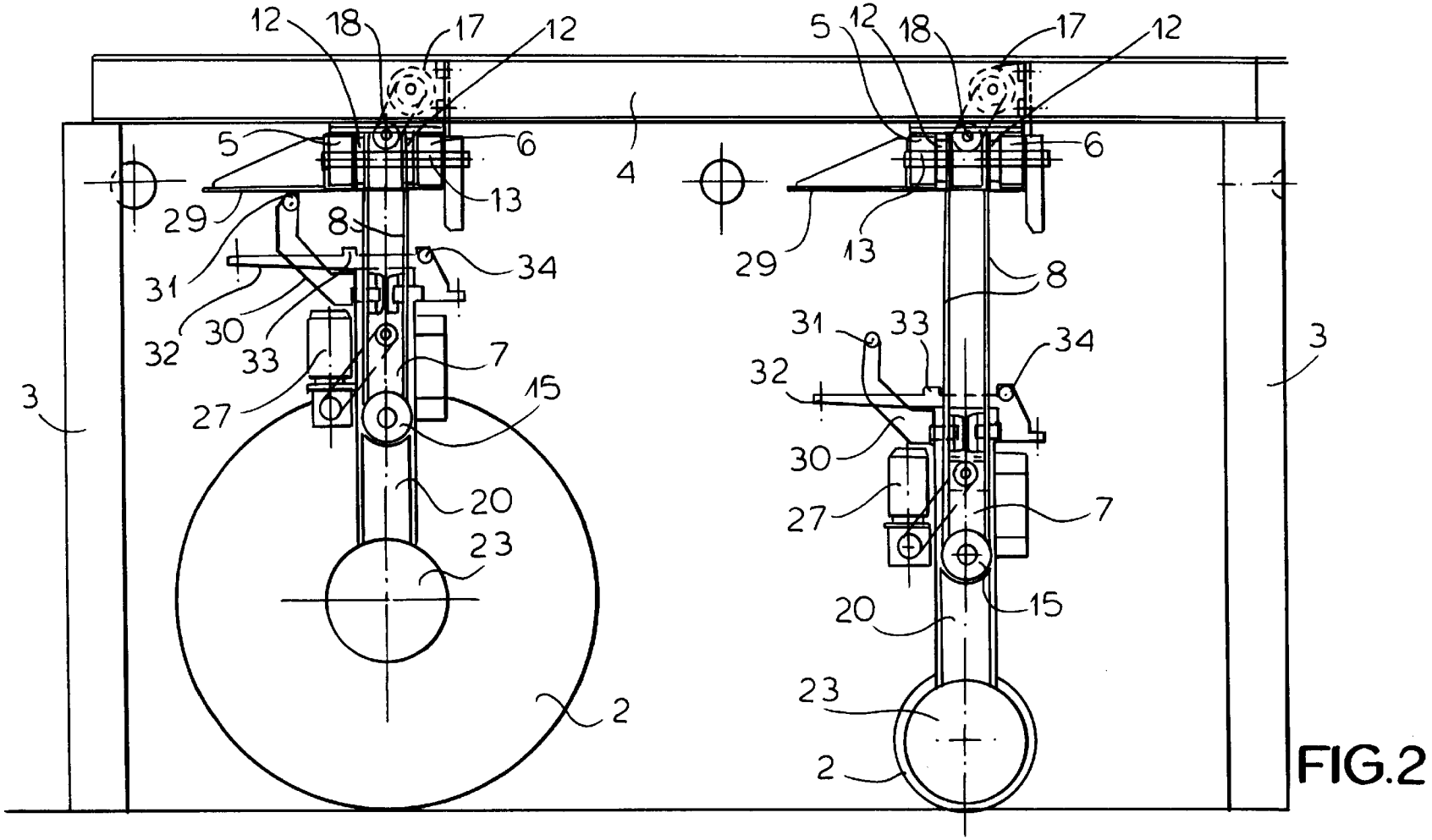
FIGS. 2 and 3 show respective side views in which different working positions are illustrated.
Figure 3:
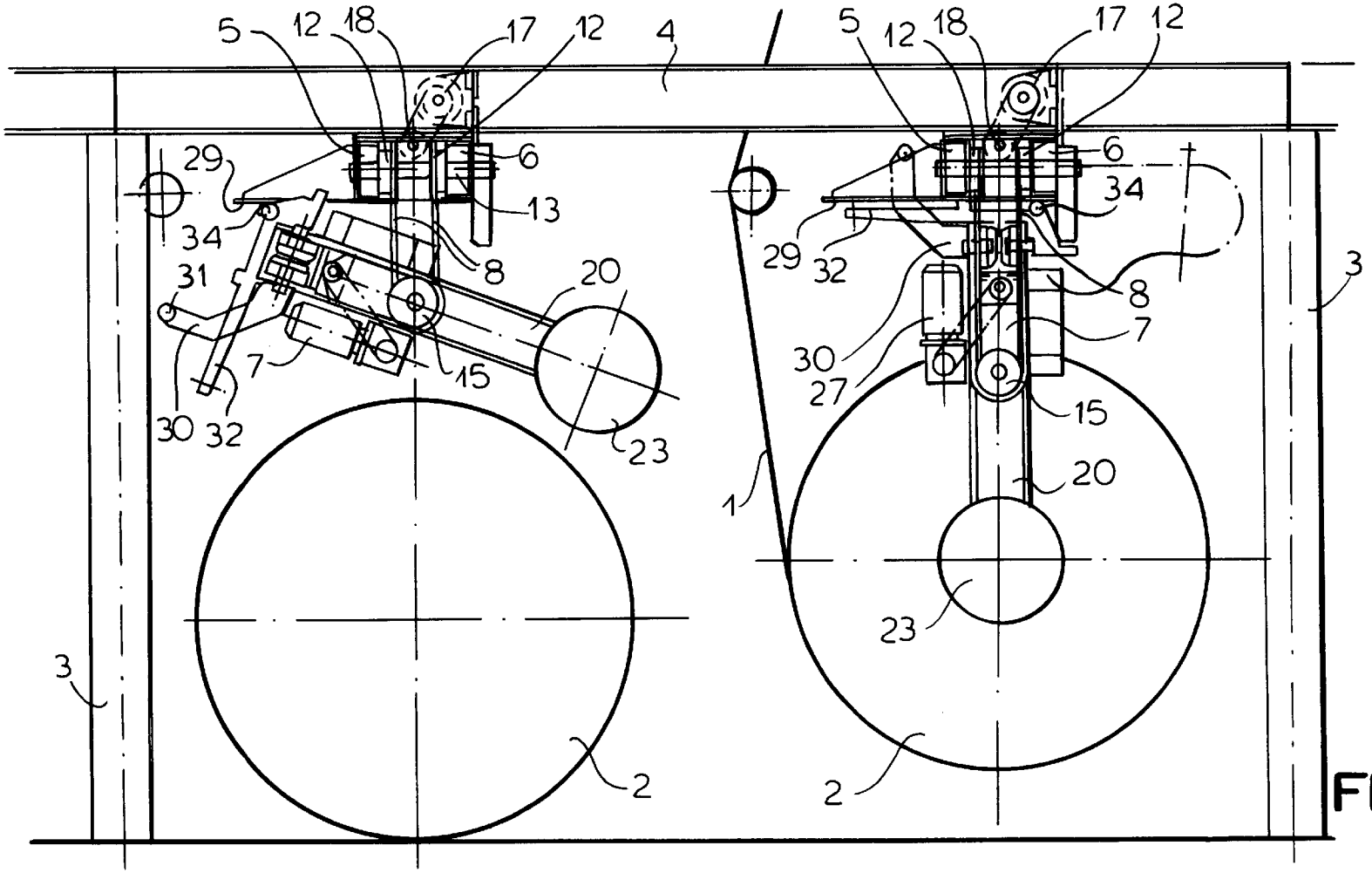

The unwinding beam 7 with all of the parts affixed thereon (unwinding arms 19, 20, guide heads 22, brakes 23, motors 24, 27 etc.) is—as shown at the left in FIG. 2—swingable about the rotation axis of the cable pulleys 14, 15 to enable a swinging of the support arms 19, 20 and the parts affixed thereto, a lateral free space is obtained through which a new wound roll 2 can be fed in the axial direction from the exterior into the region between the support arms 19, 20. For this purpose, the support arms 19, 20 are automatically moved into a vertical position and the center of gravity of the swingable unwinding beam 7 with the parts affixed thereto lies below the rotation axis of the cable pulleys 14, 15. The swinging movement of the unwinding beam is effected automatically by lifting to the extent that the front (in FIG. 1 to the right) unwinding arm 20 is in a predetermined transverse position outside the region of maximum working width. In this region an abutment plate 29 is arranged in the vicinity of the longitudinal beam 4 below the transverse beams 5 and 6 against which a guide arm 30 is braced for the lifting action and which is affixed to be angled upwardly on the support arm 20. The guide arm 30 carries at its end a roller 31 which rides on the abutment plate 29. In the transverse direction somewhat offset from the arm 30 an abutment profile 32 is affixed on the unwinding beam 7 and runs approximately parallel to the abutment plate 29 and has abutments 33, 34 to both sides of the cable 8 with which the unwinding beam 7 can be fixed in an unwinding position on the transverse beams 5, 6. Upon an upward swing of the support arm 20 within the working range—and also outside this range in which the arm 30 moves counter to the abutment plate—the cables 8 draw the abutments 33, 34 against the transverse beams 5, 6 and the abutment profile 32 against the abutment plate 29 and hold the support arms 19, 20 against tilting in the unwinding direction.

The abutment 34 on the right in FIG. 2 of the abutment profile 32 is formed as a roller. It serves, upon swinging of the support arms 19, 20 to roll on the abutment plate 29 to promote the swinging movement when the rollers 31 leave the arms 30 of the abutment plate 29.

For charging the unwinding device with a new wound roll 2, initially the two support arms 19, 20 are found in lowered positions and outwardly moved until the guide arm 30 is located in the region of the abutment plate 29. Then the unwinding beam 7, as has been shown at the left in FIG. 3, is raised until the guide arm 30 moves against the abutment plate 29 and thereby effects a swinging movement. The result is a lateral free space through which a new wound roller 2 can be fed into the device. After the wound roller 2 is fed into place, the unwinding beam 7 is initially lowered with the support arms 19, 20 and the support arms 19 and 20 are sufficiently displaced together until the roller 31 leaves the abutment plate 29, whereby the support arms 19, 20, because of their intrinsic weights, orient themselves vertically. The guide heads 22 are axially positioned flush vertically with respect to the wound roll 2. With wound rolls and the maximum diameter (FIG. 2 left) the roller 31 of the guide arms 30 lies below the abutment plate 29 while with wound rolls with a minimum diameter (FIG. 2 right) the brake 23 lies directly above the bottom.

By movement of the support arms 19 and 20 toward one another, the guide heads 22 are moved into the winding sleeve. The wound roll 2 is then lifted via the guide heads 22 in that lifting motor 17 displaces the cables 8 and the unwinding beam 7 suspended therefrom upwardly. During this vertical movement into the unwinding position, the guide arm 30 finds itself externally of the region of the abutment plate 29 so that it can move past the latter vertically without inducing a swinging movement (FIG. 1, FIG. 3 right). In this unwinding position, the cables 8 draw the unwinding beam 7 with its abutments 33, 34 rigidly against the undersides of the transverse beams 5, 6 and fix the latter with the abutment profile 32 so that a tilting of the unwinding beam 7 during web withdrawal, i.e. the payoff of the paper or cardboard web, 1 is excluded.

I claim:

1. An unwinding device for wound rolls, comprising:

a frame formed from longitudinal girders and transverse girders;

an unwinding beam mounted in the frame, said unwinding beam extending transversely over a working width and having two support arms transversely shiftably mounted thereon and which carry at their free ends respective guide heads for insertion in the sleeve of a wound roll;

tension means suspending the unwinding beam so as to be raisable and lower-able in the frame; and a lifting drive, said unwinding beam being suspended in said frame to swing freely with a pendulum movement for automatic entry of said heads into said roll connected with said tension means for raisins and lowering the unwinding beam.

2. An unwinding device according to claim 1 wherein the tension means includes a respective elongated element on each of two opposite machine sides and formed by a cable, a belt or a chain, and which are connected in common with said lifting drive.

3. An unwinding device according to claim 1, wherein the support arms are movable toward and away from one another on the unwinding beam by an adjustment drive affixed on the unwinding beam.

4. A device according to claim 3 wherein the support arms are additionally mounted so as to be transversely shiftable limitedly equidistantly by means of a positioning drive.

5. An unwinding device for wound rolls, comprising:

a frame formed from longitudinal girders and transverse girders;

an unwinding beam mounted in the frame, said unwinding beam extending transversely over a working width and having two support arms transversely shiftably mounted thereon and which carry at their free ends respective guide heads for insertion in the sleeve of a wound roll;

tension means suspending the unwinding beam so as to be raisable and lowerable in the frame; and a lifting drive connected with said tension means for raising and lowering the unwinding beam, the unwinding beam with the support arms affixed thereon being swing ably suspended in the frame.

6. An unwinding device according to claim 5 at opposite ends of the unwinding beam a roller is affixed, each of said rollers being suspended in a loop of the tension means, whereby the unwinding beam is swingable about an axis of the rollers and has a center of gravity which lies below the axis of the rollers.

7. An unwinding device according to claim 5, wherein outwardly of a working region below a girder transverse to said unwinding beam an abutment is arranged which, in cooperation with guide elements on the unwinding beam releases a swinging movement upon raising of the unwinding beam.

8. An unwinding device according to claims 7, wherein the unwinding beam has an abutment on an upper side therewith which is movable against said girder transverse to the unwinding beam to fix the unwinding beam in an unwinding position.

* * * * *